US007234775B2

(12) United States Patent
Serber

(10) Patent No.: US 7,234,775 B2
(45) Date of Patent: Jun. 26, 2007

(54) DYNAMICALLY BALANCED SEAT ASSEMBLY HAVING INDEPENDENTLY AND ARCUATELY MOVABLE SEAT AND BACKREST AND METHOD

(76) Inventor: Hector Serber, 695 DeLong Ave. #50, Novato, CA (US) 94945

( * ) Notice: Subject to any disclaimer, the term of this patent is extended or adjusted under 35 U.S.C. 154(b) by 0 days.

(21) Appl. No.: 10/175,452

(22) Filed: Jun. 18, 2002

(65) Prior Publication Data

US 2003/0230918 A1 Dec. 18, 2003

(51) Int. Cl.
*A47C 1/024* (2006.01)

(52) U.S. Cl. ..... 297/301.1; 297/300.1; 297/411.37

(58) Field of Classification Search ..... 297/313, 297/320, 323, 316, 340, 354.1, 354.11, 354.12, 297/411.35, 411.57, 411.38, 411.36, 337, 297/411.29, 411.4, 411.41, 301.1, 301.4, 297/301.3, 361.1, 281, 282, 283, 273, 300.1, 297/383, 258.1, 411.37, 300.2, 283.1, 301.2
See application file for complete search history.

(56) References Cited

U.S. PATENT DOCUMENTS

| | | | | | |
|---|---|---|---|---|---|
| 4,043,594 | A | * | 8/1977 | Cabell | 297/353 |
| 4,589,697 | A | * | 5/1986 | Bauer et al. | 297/301.2 |
| 4,911,501 | A | * | 3/1990 | Decker et al. | 297/300.8 |
| 5,009,467 | A | * | 4/1991 | McCoy | 297/411.36 |
| 5,024,484 | A | * | 6/1991 | Buchacz | 297/300.3 |
| 5,042,876 | A | * | 8/1991 | Faiks | 297/301.4 |
| 5,244,252 | A | | 9/1993 | Serber | |
| 5,261,723 | A | * | 11/1993 | Hosoe | 297/344.14 |
| 5,308,145 | A | * | 5/1994 | Koepke et al. | 297/342 |
| 5,366,269 | A | | 11/1994 | Beauvais | |
| 5,437,494 | A | | 8/1995 | Beauvais | |
| 5,460,427 | A | | 10/1995 | Serber | |
| 5,558,399 | A | | 9/1996 | Serber | |
| 5,577,802 | A | | 11/1996 | Cowan et al. | |
| 5,660,439 | A | * | 8/1997 | Unwalla | 297/316 |
| 5,725,276 | A | * | 3/1998 | Ginat | 297/289 |
| 5,735,574 | A | | 4/1998 | Serber | |
| 5,961,073 | A | | 10/1999 | Whittman | |
| 5,975,634 | A | | 11/1999 | Knoblock et al. | |
| 5,979,984 | A | | 11/1999 | DeKraker et al. | |
| 6,022,071 | A | * | 2/2000 | Smith | 297/88 |
| 6,030,043 | A | * | 2/2000 | Habedank | 297/342 |
| 6,086,153 | A | | 7/2000 | Heldmann | |
| 6,099,076 | A | * | 8/2000 | Nagel et al. | 297/337 |
| 6,105,457 | A | * | 8/2000 | Strasser | 74/501.5 R |
| 6,135,554 | A | * | 10/2000 | Tsun et al. | 297/327 |
| 6,334,648 | B1 | | 1/2002 | Girsberger | |
| 6,523,898 | B1 | * | 2/2003 | Ball et al. | 297/320 |
| 6,565,155 | B1 | * | 5/2003 | Huang | 297/353 |
| 6,685,267 | B1 | * | 2/2004 | Johnson et al. | 297/300.1 |
| 6,705,677 | B2 | * | 3/2004 | Oshima et al. | 297/300.2 |
| 6,709,058 | B1 | * | 3/2004 | Diffrient | 297/320 |
| 2001/0005094 | A1 | * | 6/2001 | Hancock | 297/301.1 |

* cited by examiner

*Primary Examiner*—Milton Nelson, Jr.
(74) *Attorney, Agent, or Firm*—Dorsey & Whitney LLP

(57) ABSTRACT

A seat assembly (21) including a seat (22), a backrest (23) and a mounting assembly (24) mounting the seat (22) in a near horizontal orientation for movement along an upwardly concaved arcuate seat path having a center of curvature (37) proximate the center of mass (39) of a person seated on the seat, and the mounting assembly (24) further mounting the backrest (23) in a near vertical orientation for movement independently of the seat along a forwardly concaved arcuate path having a center curvature (37) proximate the center of mass (39) of the person. An adjustment assembly (61) is provided for adjusting the radius of curvature of the path of motion of the backrest (23). Also provided are a backrest tilt adjustment assembly (71), an armrest adjustment assembly (90), a seat biasing assembly (110) and a seat motion latching assembly (111). A method of self-adjusting support and alignment of a backrest also is disclosed.

20 Claims, 5 Drawing Sheets

DYNAMICALLY BALANCED SEAT ASSEMBLY HAVING INDEPENDENTLY AND ARCUATELY MOVABLE SEAT AND BACKREST AND METHOD

TECHNICAL FIELD

The present invention relates, in general, to seat assemblies of the type commonly found in office environments, and more particularly, to seat assemblies having movable seats and movable backrests and methods for support of users thereon.

BACKGROUND ART

Considerable work has been directed toward the development of seat assemblies or chairs which are ergonomically well suited for use by persons who are engaged in tasks that require that they be seated for prolonged periods of time. Typical of such applications are the seats or chairs which are used in offices or at home for tasks such as typing, reading and computer use.

In recent years it has been recognized that it is highly desirable for such seat assemblies or chairs to be constructed in a manner which allows the seat to move along an upwardly concaved arcuate path, or some approximation thereof. Such arcuate movement is most desirably implemented by mounting the seat for movement about an arcuate path having a center of curvature which is proximate the center of mass of the person seated on the seat. This geometry dynamically balances the bio-mechanics of a user's body with movement of the chair so that the user can have a plurality of equilibrium positions in a variety of postures. The design principle is one of counterbalanced motion in which the mass of the user's body is counterbalanced by angular forces of the motion of the seat in a fore-and-aft direction.

My previous U.S. Pat. Nos. 5,244,252; 5,460,427; 5,558,399 and 5,735,574 describe in more detail the advantages of mounting a seat for movement along an upwardly concaved path having a center of curvature proximate the center of mass of the person seated on the seat. These patents are incorporated herein by reference. Such seat assemblies also are particularly well suited for use in vehicles in order to dissipate the dynamic forces generated when the vehicle is involved in a sudden deceleration or crash.

In addition to mounting the seat of a chair for arcuate movement, it is also well known to mount the back of the seat assembly for movement or for movement of a portion of the back, such as the lumbar support region. Various schemes for moving the back are also disclosed in my above-referenced patents. Most of these movable back mounting systems couple the back to the seat and have been designed primarily for dynamic deceleration in vehicles, but they are usable to varying degrees in office chairs.

U.S. Pat. Nos. 5,261,732; 5,366,269; 5,437,494; 5,577,802; 5,961,073; 5,979,984 and 6,334,648 disclose chairs or seat assemblies in which one or both of the back and seat are mounted for movement. It is also well known in office chairs and the like to provide for backrest reclining mechanisms as, for example, are shown in U.S. Pat. Nos. 5,975,634 and 6,086,153.

Generally, however, there still remains a need for a chair or seating assembly which can be used for long periods of time that has a movably mounted seat and backrest which will accommodate a wide range of seating postures while providing many balanced or equilibrium positions matched to the bio-mechanics of the user's body. Thus, the person using the chair will want to assume various postures, such as a forward reaching posture (where the person is performing manual tasks on a support surface such as a desk), or an erect posture (for tasks such as typing), or a semi-reclined posture for increased comfort. The seat and backrest should be movable to an equilibrium position about which dynamic micro-adjustments of the user's body and the seat assembly about the center of mass of the user are possible in order to provide the greatest comfort during prolonged use.

DISCLOSURE OF THE INVENTION

The seat assembly of the present invention is comprised, briefly, of a seat, a backrest and a mounting assembly mounting the seat in a near horizontal orientation for movement along an upwardly concaved arcuate seat path having a center of curvature proximate the center of mass of a person seated on the seat. The seat mounting assembly further mounts the backrest in a near vertical orientation for movement independently of the seat along a forwardly concaved arcuate backrest path having a center of curvature which also is proximate the center of mass of the person seated on the seat. Most preferably, the center of curvature of the seat path and the center of curvature of the backrest path are concentric. The seat assembly also further preferably mounts the seat for fore and aft tilting about a horizontal plane and includes an adjustment assembly formed to enable adjustment of the radius of curvature of the backrest path of motion without changing the relative positions of centers of curvature of the seat and backrest. A backrest tilting mechanism is also provided, as is an armrest adjustment mechanism.

The method of self-adjusting support and alignment of the position of a backrest assembly is comprised briefly of the steps of mounting a seat for pivoting about an axis proximate the center of mass of the user seated on the seat; and mounting the backrest to pivot or rotate independently of the seat about an axis proximate the center of mass of the user.

BEST MODE OF CARRYING OUT THE INVENTION

The seat assembly of the present invention employs a seat mounting assembly which allows the seat to move along an upwardly concaved arcuate path having a center of gravity proximate the center of gravity of the user or person seated on the seat. This is broadly known in the prior art, as indicated above and enables the user to periodically adjust the seat position while maintaining the mass of the user center or balanced or in equilibrium on the seat for various arcuate positions. The present chair assembly also employs a backrest which is movable about the same center of mass independently of the seat to afford further balanced comfort for extended seat assembly use.

Figure 1:
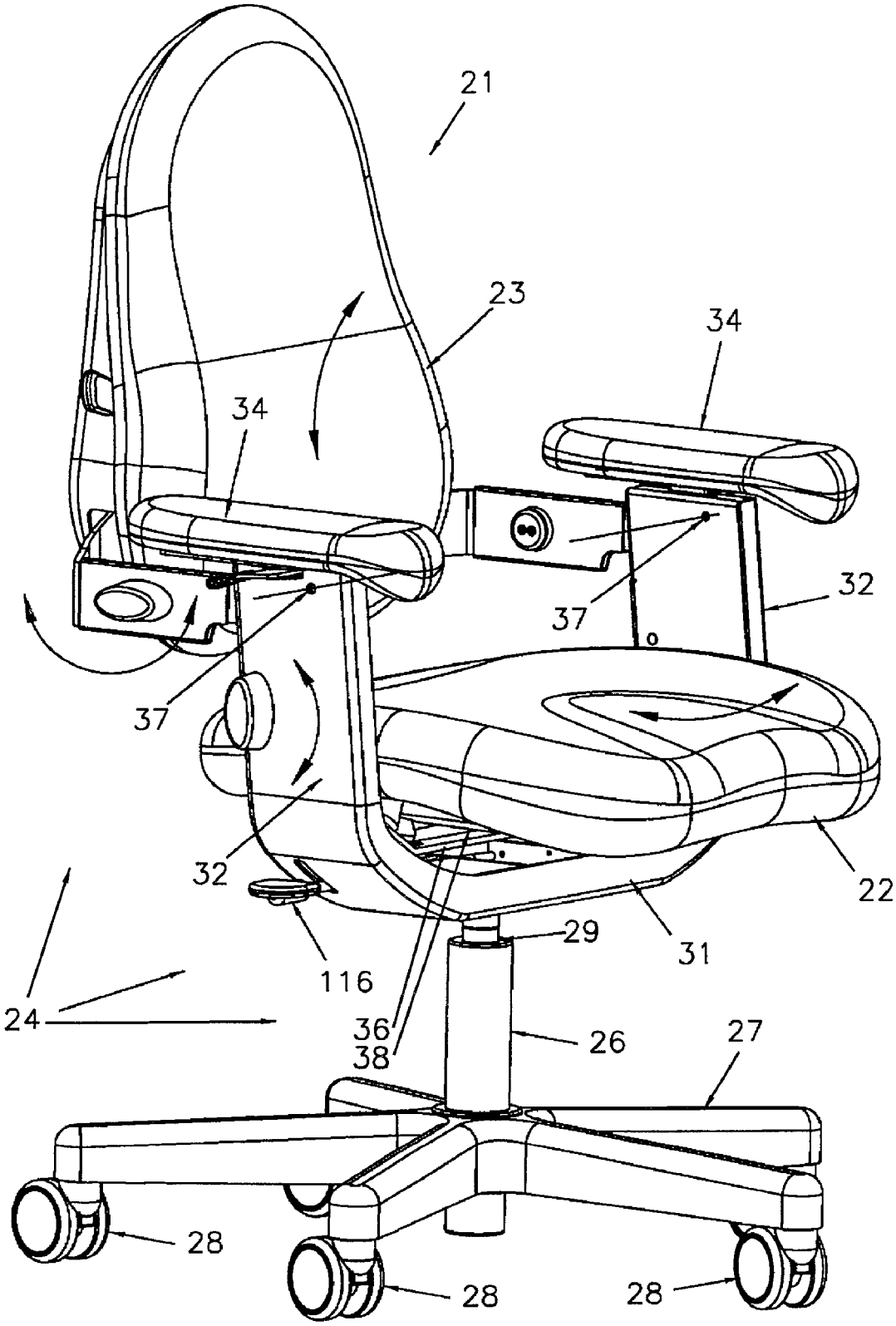
FIG. 1 is a top perspective view of a seat assembly constructed in accordance with the present invention.

Referring to FIG. 1, the chair or seat assembly of the present invention, generally designated 21, can be seen to include a seat 22 and backrest 23 that are supported by a seat mounting assembly, generally designated 24. Seat mounting assembly 24 can include a conventional vertically adjustable, telescope-type, pedestal 26 which is rollingly supported by a plurality of roller elements 28 mounted to radially extending legs 27, which elements are conventional and well known in the art. It also should be noted that other supporting structures can be substituted for pedestal 26. For example, the seat assembly of the present invention can be mounted to standard 3 or 4 legged bases, bent tubing base.

In the embodiment shown in the drawing, mounting assembly 24 also includes a U-shaped frame 31 mounted on top of pedestal 26, which frame has upwardly extending frame arms 32 on which armrests 34 are mounted. Seat 22 is mounted to a U-shaped cradle 36 positioned inside U-shaped frame 31 and pivoted thereto at pivot mount 37 proximate the upper end of arms 32. Cradle 36 can include a seat mounting plate 38 to which seat 22 can be fastened.

Figures 3, 4, 5:
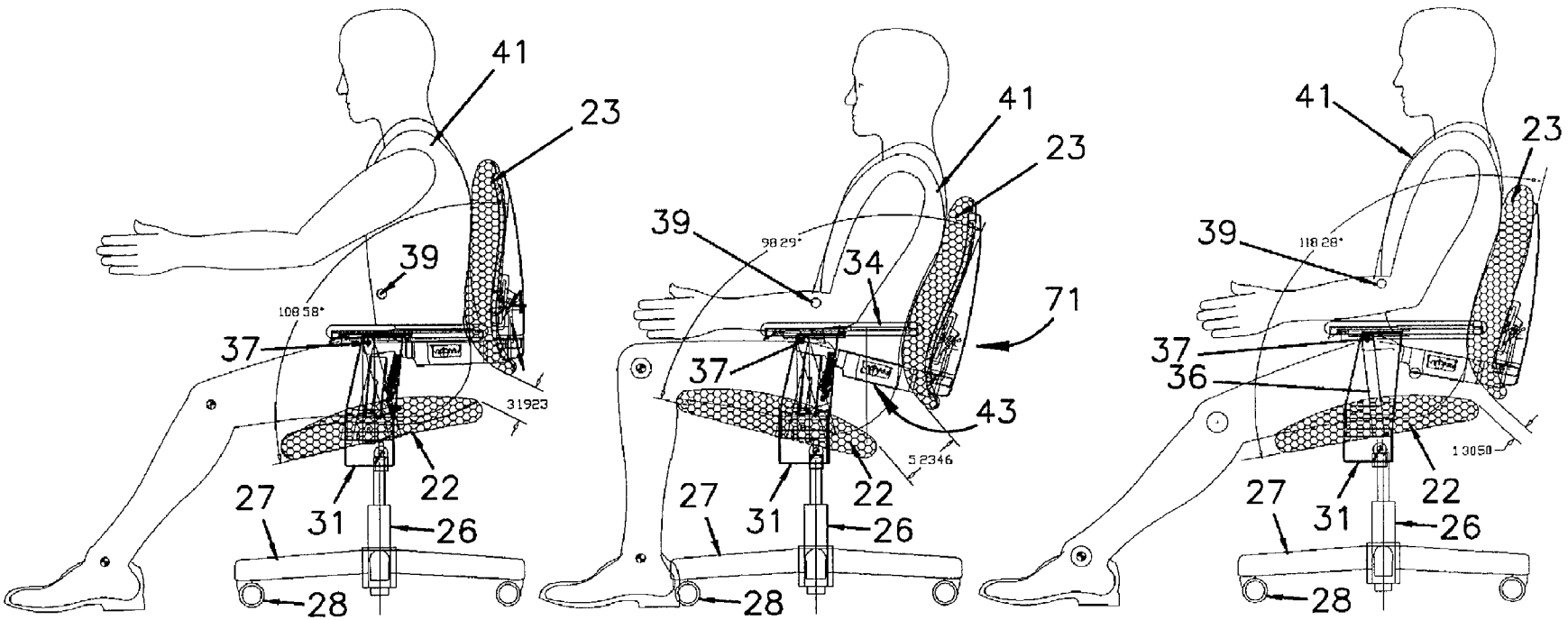
FIGS. 3, 4 and 5 are schematic side elevation views of the seat assembly of FIG. 1 with a user seated on the seat assembly while assuming various postures.

As may be seen in FIGS. 3–5, seat 22 is mounted by cradle 36 for pivoting about an axis 36 proximate the center of mass 39 of a person or user 41 seated on seat 22. By comparing FIGS. 3, 4 and 5, the center of mass 39 of user 41 can be seen to remain closely proximate the axis through pivot mount 37 of seat cradle 36 for the full range of postures shown in FIGS. 3–5.

In the improved seating assembly of the present invention, mounting assembly 24 further mounts backrest 23 in a near vertical orientation for movement independently of seat 22 along a forwardly concaved arcuate path having a center of curvature which also is proximate the center of mass 39 of the person seated on the seat. Most preferably, the center of curvature of the arcuate backrest path is coincident or concentric with the center of curvature 37 for the arcuate seat path.

Figure 2A:
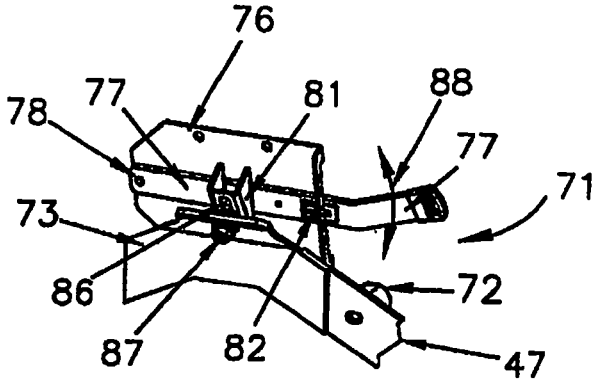
FIG. 2*a* is a fragmentary, rear elevation view of the backrest tilting mechanism shown in FIG. 2.
Figure 2:
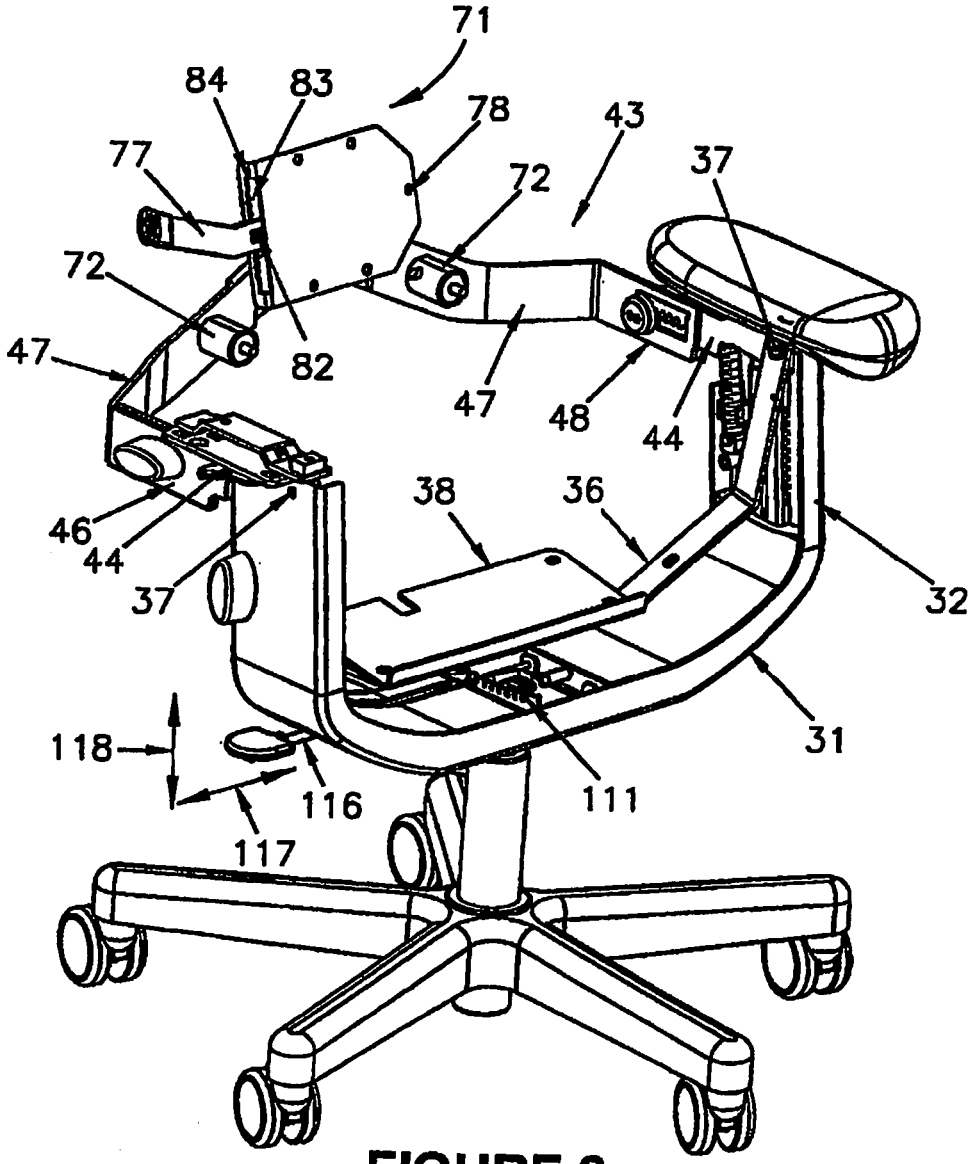
FIG. 2 is a slightly enlarged view of the seat assembly of FIG. 1 with the seat and backrest and selected frame panels removed.
Figure 6:
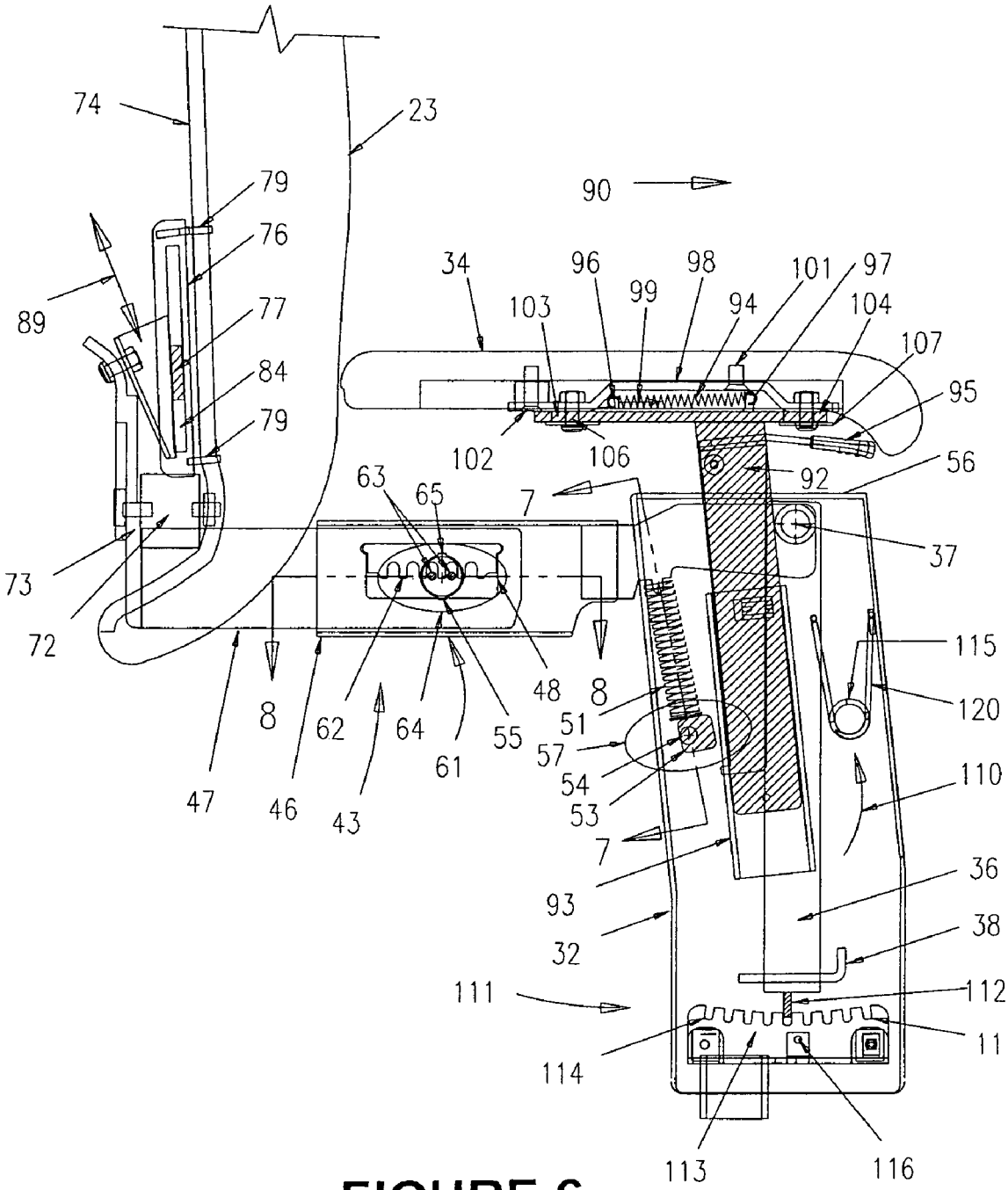
FIG. 6 is an enlarged, fragmentary, side elevation view of the seat assembly of FIG. 1.
Figure 7:
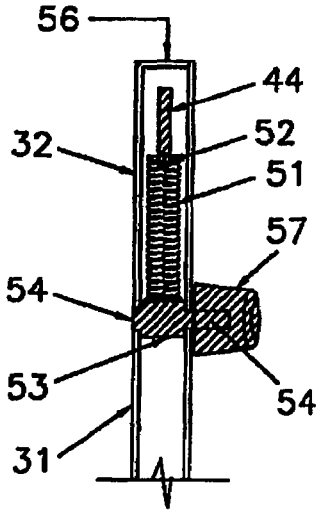
FIG. 7 is a cross section view taken substantially along the plane of line 7—7 in FIG. 6.

Mounting of backrest 23 by mounting assembly 24 can best be understood by reference to FIGS. 2 and 6. Thus, mounting assembly 24 of the present invention also includes a U-shaped back support assembly, generally designated 43, which may include a pair of stub arms 44 having a sleeve 46 secured thereto, for example, by welding, and a U-shaped back strap member 47 with strap ends 48 slidably telescoped inside sleeve 46. As best can be seen in FIG. 6, stub arm portions 44 of the back support assembly 43 are pivoted at pivotal mount 37 to upper end of frame arms 32. Also mounted to frame member 31 is a compression spring 51 having an end which engages a protrusion or tooth 52 on arm stub 44 and an opposite end which is supported by a rotatably mounted cam 53. Axle 54 for the cam is secured for rotation to frame arm 32, as best may be seen in FIG. 7. Spring 51, therefore, biases back support assembly 43 to essentially the position shown in FIG. 6, that is, to the point that stub arm 44 engages top member 56 of the U-shaped frame arm.

Rotation in a counterclockwise direction in FIG. 6 of backrest 23, therefore, is resisted by compression spring 51, and the degree of rotation will depend upon the weight applied to backrest 23 by the user and the spring force in spring 51. Adjustment of the spring force in spring 51 is accomplished by rectangular cam 53 which is rotated by the user by turning manually engageable handle 57. Thus, if the user wants to increase the resistance to counterclockwise rotation of backrest 23, handle 57 can be rotated in a counterclockwise direction which rotates square cam 53 by 90 degrees from the FIG. 6 position to a position producing maximum compression of spring 51. If the user wants to reduce the spring force, handle 57 is rotated in a clockwise direction by 90 degrees so that spring 51 can extend and upward biasing force on the back support assembly 43 will be reduced. This eases the resistance to arcuate movement of the backrest.

The advantages of having backrest 23 and seat 22 which are both independently movable along arcuate paths having centers of curvature proximate the center of mass of the person seated on the chair, can be seen by comparing the postures which can be achieved in FIGS. 3, 4 and 5. In FIG. 3 an erect posture with a downwardly tilting seat and a near vertical backrest is achieved. In FIG. 4 the seat is pivoted back, while the backrest is also pivoted downwardly. In FIG. 5 the seat is only partially rearwardly pivoted, while the backrest also is only partially downwardly pivoted. In each posture center of mass 39 remains in a balanced position proximate the center of pivoting of the seat and backrest. As also can be seen, the spacing between the seat and backrest varies with each posture for improved comfort.

Figure 8:
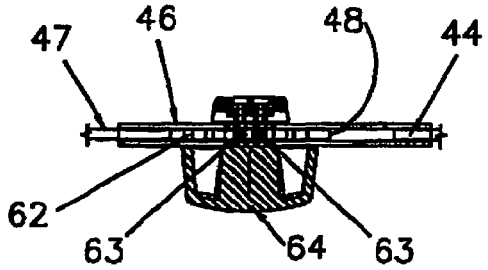
FIG. 8 is a top cross sectional view taken substantially along the plane of line 8—8 in FIG. 6.

Another feature of the present invention that the radius of the center of curvature of backrest 23 can be adjusted. Thus, backrest support assembly 43 includes an adjustment assembly, generally designated 61, which is formed for adjustment of the length of the back support assembly between backrest 23 and pivotal mount 37. In FIG. 6 end 48 of seat support strap 47 can be seen to include a rack structure 62 into which a pair of transversely extending pins 63 can be received. Pins 63 are carried by a rotatable knob assembly 64 mounted for rotation to sleeve 46 (see FIG. 8). Rotation of knob assembly 64 in a clockwise direction causes the pins to walk along rack 62 and displace strap 47 forwardly toward U-shaped frame 31. Rotation of knob 46 in a counterclockwise direction displaces strap 47 and backrest 23 in a rearward direction as the pins 63 walk along rack 62. In order to resist unwanted rotation of knob 64 and pins 63 upon application of a rearward force to backrest 23 when the user leans back on the backrest, a detent in the form of protrusions 65 and a notch 55 can be provided on adjustment assembly 61.

The change in the length of back support assembly 43 allows the seat to accommodate users of different sizes with the result that the center of mass 39 for users of different sizes remains proximate the center of pivoting 37 of seat 22 and of backrest 23. Moreover, the change in radius of curvature of the path of motion of backrest 23 is not accompanied by a change in the relative position of the center of curvature of the seat and the center of curvature of the backrest. Even for users of the same size, adjustment of the radius of curvature of the backrest may produce a comfort level for a particular user which is enhanced and still will result in positioning of the user's center of mass 39 proximate pivot point 37 for all backrest 23 and seat 22 positions.

It also can be advantageous to change the radius of pivoting of seat 22 without changing the relative position of the seat and backrest. Thus, change of length assembly 61 can be mounted to seat cradle 36 between pivotal mount 37 and seat mounting plate 38. This would enable the user to change the radius of rotation of seat 22.

It is further preferable in the seat assembly of the present invention to include a backrest tilt adjustment assembly, generally designated 71, and best seen in FIGS. 6 and 2*a*. Backrest tilt adjustment assembly 71 is coupled between back support assembly 43 and backrest 23 and is formed for manual adjustment of the angle of the backrest relative to backrest support assembly 43. In the illustrated embodiment, backrest 23 is mounted proximate a lower side thereof by flexible bushings 72 to back support strap 47. Strap 47 also carries a back mounting plate 73 which extends to a position above flexible bushings 72. A back plate 74 of the backrest has a lever plate 76 secured thereto by fasteners 79. A lever 77 is pivotally mounted to plate 76 at pivot point 78. Welded to lever 77 for movement therewith is a wedge member 81 that has a slotted back 86. Lever 77 also carries a latching tooth 82 (FIGS. 2 and 2*a*) which interengages with a series of teeth 83 provided in a slotted flange 84 of lever plate 76. (The latching tooth 82 and rack 83 are not shown in FIG. 6.) As can be seen from FIG. 2*a*, wedge slot 86 receives a bolt or fastener 87 that is secured to upwardly extending plate 73 carried by back strap 47. The slot 86 is dimensioned for sliding engagement around fastener 87 so that pivoting of lever 77, as indicated by arrows 88, about pivot 87 results in upward and downward displacement of wedge member 81, as indicated by arrows 89 in FIG. 6.

As lever 77 is pivoted downwardly, therefore, wedge 81 wedges between member 73 and the backrest so as to tilt backrest 23 in a forward direction about flexible bushings 72. Conversely, the backrest can be selectively reclined by rotating lever 77 in an upward direction about pivot 78.

It is preferable in the seating assembly of the present invention that armrests 34 also be adjustably mounted to U-shaped frame member 31. Thus, as best may be seen in FIGS. 6 and 9, armrests 34 can be mounted on plate 91 which fixed to a downwardly depending post 92 that is slidably received in a mating sleeve 93 secured inside arms 32 of the U-shaped frame. Vertical adjustment of armrests 34 by sliding a post 92 inside sleeve 93 will not be described in more detail but can be released by lifting lever 95 and locked in place by letting go of the lever, as is well known in the art.

Figure 9:
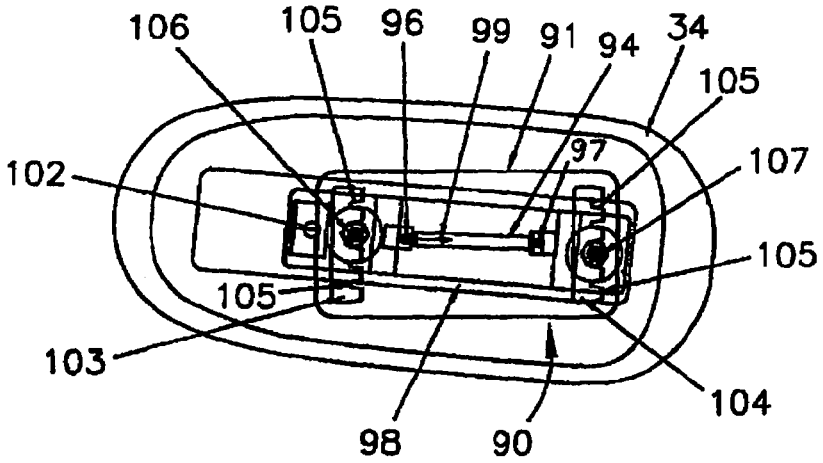
FIG. 9 is a top plan view of the armrest assembly of FIG. 6.

The horizontal adjustment mechanism 90 armrests 34 can best be understood by reference to FIGS. 6 and 9. A spring 94 is secured at end 96 to hat-shaped plate member 98 at one end and at an opposite end to plate 91 mounted on top of post 92. Spring 94 is a tension spring so that it tends to pull the hat-shaped member in a forward direction, as indicated by arrow 99 relative to plate 91. Mounted on hat-shaped member 98 by fasteners 101 and 102 is armrest cushion assembly 34. Plate 91 is provided with two cutout areas 103 and 104, which define a plurality rack comprised of teeth 105 dimensioned to receive bolts 106 and 107 therebetween. As so constructed, therefore, the user can manually grip the armrest 34 and pull it rearwardly against the biasing force 99 to slide hat-shaped member 98 and bolts 106 and 107 in a rearward direction until they clear the teeth 195 and move into the open portion of cutouts 103 and 104. Once clear of the teeth, armrest 34 can be laterally adjusted from side-to-side. The user then releases the armrest and spring 94 will bias the armrest forward, causing bolts 106 and 107 to re-engage with teeth 105 and lock the armrest in place. As can be seen in FIG. 9, it is possible to skew each armrest to an angle from a forward direction, either inwardly or outwardly, by seating bolts 106 and 107 in pockets in the cutouts 103 and 104 defined by teeth 105 that are not aligned in a forward direction.

As constructed, therefore, the armrest adjustment assembly enables lateral shifting of one or both of the armrests as well as angular adjustment of the orientation of each armrest independently.

It is a further feature of the present invention that chair assembly 21 can be provided with a biasing assembly 110 which biases seat 22 to rotate in a rearward direction. As may be seen in FIG. 6, such biasing can be accomplished by torsion springs 115 mounted in each frame arm between seat cradle 36 and frame arm 32. Although not shown, a biasing adjustment assembly also can be provided, for example, by mounting a cam, such as cam 53, between leg 120 and the frame arm wall. Spring 115 also can be positioned at other radial distances from pivot 37 to vary the movement around the pivot. Biasing of seat 22 rearwardly resists the tendency of the user to slouch or rotate his or her hips forwardly while seated on chair 21.

Finally, chair assembly 21 can also include a latch or brake assembly, generally designated 111 (FIGS. 2 and 6), which enables the user to selectively lock seat 22 in a desired position against arcuate movement. Brake or latching assembly 111 can be provided by a tooth 112 depending down from seat supporting cradle 36, and a latching or brake rack 113 which has a plurality of pockets 114 dimensioned to receive the tooth 112. Manually engageable handle 116 (FIG. 2) can be used to displace rack 113 into engagement with tooth 112 by pulling the rack outwardly, as indicated by arrows 117. Release of the rack is accomplished by pushing the handle 116 inwardly. The same handle 116 can be reciprocated vertically in order to adjust the height of the pedestal, as indicated by arrows 118, which pedestal adjustments are well known in the industry.

The method of the present invention will be understood to be comprised of the steps of mounting seat 22 for pivoting or rotation about an axis 37 proximate center of gravity 39; and mounting backrest 23 for rotation independently of seat 22 about an axis, preferably axis 37, proximate center of gravity 39.

What is claimed is:

1. A seat assembly comprising:

(a) a seat;

(b) a backrest; and (c) a mounting assembly mounting said seat in a near horizontal orientation for balanced movement along an upwardly concaved arcuate seat path having a center of curvature above the seat and forward of the backrest, said mounting assembly further mounting said backrest in a near vertical orientation for balanced movement independently of said seat along a forwardly concaved arcuate back path having a center of curvature above the seat and forward of the backrest;

wherein said mounting assembly includes a pedestal, a U-shaped frame mounted to the pedestal with a pair of upwardly extending frame arms, a U-shaped seat support cradle pivotally mounted between said frame arms from proximate a top of said frame arms and downwardly depending therefrom, said seat being carried by said seat cradle for pivotal movement relative to said frame arms, and said mounting assembly further including a U-shaped back support assembly pivotally mounted to said frame arms and extending rearwardly thereof, a biasing assembly biasing the back support assembly to a near horizontal orientation, said backrest being mounted to said back support assembly.

2. The seat assembly as defined in claim 1 wherein,
the center of curvature of the path of the seat and the center of curvature of the path of the backrest are concentric.

3. The seat assembly as defined in claim 1, and
an adjustment assembly provided on said mounting assembly and formed to enable adjustment of the radius of curvature of the path of motion of the backrest without changing the relative positions of the centers of curvature of the seat and the backrest.

4. The seat assembly as defined in claim 1 wherein,
said biasing assembly is adjustable as to a force upwardly biasing said seat support cradle.

5. The seat assembly as defined in claim 1 wherein,
said back support assembly includes an adjustment assembly formed for adjustment of the length of the back support assembly between said backrest and the pivotal mount to said frame arms.

6. The seat assembly as defined in claim 1 wherein,
said backrest includes a backrest tilt adjustment assembly formed for fore-and-aft adjustment of the angle of the backrest relative to a vertical plane.

7. The seat assembly as defined in claim 1 wherein,
said backrest includes a backrest tilt adjustment assembly coupled to said back support assembly and formed for manual adjustment of an angle of coupling of said backrest relative to said back support assembly.

8. The seat assembly in claim 1, and
an adjustment assembly provided on said mounting assembly and formed to enable adjustment of the radius of curvature of the path of motion of the seat without changing the relative positions of the centers of curvature of the seat and the backrest.

9. The seat assembly as defined in claim 1 and,
a locking assembly coupled to said mounting assembly to lock said seat to a fixed position.

10. The seat assembly as defined in claim 9 wherein,
said locking assembly includes a latch brake assembly to selectively lock the seat between said frame arms and said seat cradle.

11. The seat assembly as defined in claim 1, and an additional biasing assembly coupled to apply a biasing force to one of said seat and said mounting assembly to rearwardly pivot the seat.

12. The seat assembly as defined in claim 11 wherein,
said additional biasing assembly includes springs mounted between said frame arms and said cradle.

13. The seat assembly as defined in claim 11 wherein,
said biasing assembly is adjustable as to the force rearwardly biasing said seat.

14. The seat assembly as defined in claim 1 wherein,
said frame arms have upper ends that include armrest assemblies, and
armrest adjustment assemblies carried by said armrest assemblies and formed for adjustment of the lateral positions of said armrest assemblies relative to said frame arms.

15. The seat assembly as defined in claim 14 wherein,
said armrest adjustment assemblies are further formed for independent adjustment of the side-to-side and angular positions of said armrest assemblies relative to said frame arms.

16. The seat assembly as defined in claim 14 wherein,
said armrest adjustment assemblies each include a movable armrest element, a plate carried by a frame arm and having a rack with a plurality of teeth, a spring coupled between said movable armrest element and said plate and biasing said movable armrest element toward a latched position, and pin members positioned to releasably latch said movable armrest element in a latched condition under spring biasing of said spring.

17. A seat assembly comprising:
(a) a seat;
(b) a backrest;
(c) a mounting assembly mounting said seat in a near horizontal orientation for movement along an upwardly concaved arcuate seat path having a center of curvature above the seat and forward of the backrest and including a pair of upwardly extending frame arms, said mounting assembly further including a back support assembly mounting said backrest in a near vertical orientation for movement independently of said seat along a forwardly concaved arcuate back path having a center of curvature above the seat and forward of the backrest; said back support assembly includes a pair of stub arms each pivoted at one end to said frame arms and each including at the other end a sleeve, said back support assembly including a back strap member having opposite ends telescoped relative to the sleeves of the stub arms; an adjustment assembly formed for adjustment of the length of said back support assembly between said backrest and a pivotal mount and including a rack provided in at least one of said ends of said back strap member with a plurality of side-by-side pockets; and a rotatable member having a plurality of pins thereon dimensioned to be received in said pockets, said rotatable member being mounted to said sleeves and including a manually engageable handle thereon for rotation of said rotatable member to walk said pins along said rack and thereby displace said back strap member relative to said stub arms.

18. A seat assembly comprising:
(a) a seat;
(b) a backrest; and
(c) a mounting assembly mounting said seat in a near horizontal orientation for movement along an upwardly concaved arcuate seat path having a center of curvature above the seat and forward of the backrest, said mounting assembly including a pair of upwardly extending frame arms, said mounting assembly further including a back support assembly extending rearwardly of said frame arms in a near horizontal orientation and mounting said backrest in a near vertical orientation for movement independently of said seat along a forwardly concaved arcuate back path having a center of curvature above the seat and forward of the backrest, and an adjustable biasing assembly including a pair of compression springs each coupled at one end to said frame arms and coupled at the other end to said back support assembly to bias said back support assembly to a near horizontal position, said biasing assembly further including a pair of cams mounted for displacement of the compression springs to increase and decrease the force applied to the back support assembly, and manually engageable knobs coupled to said cams and mounted for gripping and rotation by the user to displace the cams in a manner producing at least one of increased and decreased upward biasing of the back support assembly.

19. A seat assembly comprising:
(a) a seat;
(b) a backrest; and
(c) a mounting assembly mounting said seat in a near horizontal orientation for movement along an upwardly concaved arcuate seat path having a center of curvature above the seat and forward of the backrest, said mounting assembly further including a back support assembly mounting said backrest in a near vertical orientation for movement independently of, and unconstrained by, movement of said seat along a forwardly concaved arcuate back path having a center of curvature above the seat and forward of the backrest, said backrest including a backrest tilt adjustment assembly coupled to said back support assembly and formed for manual adjustment of an angle of coupling of said backrest relative to said back support assembly, said tilt adjustment assembly includes a movable wedge secured for movement to a movable lever, said lever being pivoted to said backrest and positioned to slide against a plate carried by said back support assembly, and a flexible coupling joining said backrest to said back support assembly in a manner adapted for tilting of said backrest relative to said back support assembly.

20. The seat assembly as defined in claim 19 wherein, said flexible coupling is provided by a pair of flexible bushings.

* * * * *